United States Patent [19]

Alvarado et al.

[11] 4,103,944

[45] Aug. 1, 1978

[54] MACRAME BOARD AND KIT

[76] Inventors: Jim Alvarado; Richard G. Righter, both of 9000 Foothill Blvd., Sunland, Calif. 91040

[21] Appl. No.: 688,379

[22] Filed: May 20, 1976

[51] Int. Cl.[2] ..... D03J 3/00; D04G 3/02; D04G 5/00

[52] U.S. Cl. ..... 289/18; 28/149

[58] Field of Search ..... 289/1.5, 17, 18; 28/15, 28/149; 242/125.2; 312/231; 35/15

[56] References Cited

U.S. PATENT DOCUMENTS

| | | | |
|---|---|---|---|
| 254,258 | 2/1882 | Barbour | 28/15 |
| 254,288 | 2/1882 | Dimmick | 28/15 |
| 275,882 | 4/1883 | Brownell | 312/231 |
| 1,203,781 | 11/1916 | Ratycia | 28/15 |
| 1,456,108 | 5/1923 | Johannesen | 242/125.2 |
| 1,667,330 | 4/1928 | Odlin | 28/15 |
| 1,975,924 | 10/1934 | Collingbourne | 28/15 |
| 2,395,981 | 3/1946 | Walker | 28/15 |
| 2,486,669 | 10/1881 | Sackett | 28/15 |
| 2,558,386 | 6/1951 | Rabinowitz | 35/15 |
| 2,897,032 | 7/1959 | Kremer | 312/231 |

*Primary Examiner*—Louis K. Rimrodt

*Attorney, Agent, or Firm*—Knobbe, Martens, Olson, Hubbard & Bear

[57] ABSTRACT

A macrame board and kit includes a board member in which a central area is provided with rows and columns of uniformly spaced apertures, the lower peripheral edge is scalloped and the upper peripheral edge is given a cut-out section substantially coextensive with the lateral extent of the area which is apertured. The kit includes a plurality of peg elements adapted at one end to be detachably positioned in the apertures and at the other end to retain a cord. A bar member is provided which is adapted to be detachably secured transversely of the board in the cut-out section.

11 Claims, 13 Drawing Figures

MACRAME BOARD AND KIT

BACKGROUND OF THE INVENTION

The invention relates to the art of macrame or the knotting of cords to create a variety of patterns and more particularly to a macrame kit which can be employed with cord to form such patterns.

The art of macrame is an ancient one which has recently undergone a revival in popularity. Generally, a plurality of cords are suspended from a horizontally extending bar member and are knotted together beginning adjacent the bar member and progressing downwardly until the desired pattern is completed. However, in order to facilitate knotting of the cords a board member is frequently employed, such board being formed of a material which can be penetrated readily by a pin element used to pin the cord to the board at a specific location while the cords are knotted. Usually the board or knotting surface is positioned slightly below the horizontal bar member and, as the cords are knotted to form the desired pattern, the already completed area of the pattern is displaced upwardly over the bar member in order that a lower section of the cords can be located in the area of the knotting board. Thus, the use of a knotting board greatly facilitates handling of the cords and formation of the knotted pattern. Further, patterns made of paper can be secured to the knotting board for use as a background guide against which the knotted pattern is developed. The board, or a detachable pattern, can be sub-divided into measured areas if so desired in order to further serve as a guide in the development of the knotting.

Several disadvantages are inherent in the use of macrame boards and kits presently in use. First, no convenient means have been provided to avoid entanglement of the cords during the knotting procedure. Although T pins and U pins afford some assistance in the guidance of the cords in the board area such pins do not avoid entanglement of the cords which depend below the board. This requires periodic untangling during the knotting process. Also, the pins are pointed at one end for penetration into the board. The use of sharp needle-like elements, although necessary with the prior macrame boards, constituted a hazard and often resulted in jabs and cuts causing pain, sometimes infection, and at the least annoyance. It was also found that the pinning of the cords to the board led to fraying of the cords and ultimately to destruction of the board. Another disadvantage of macrame boards and kits currently in use is the extreme difficulty, if not impossibility, of transporting the board and the work in progress so as to enable one to continue the knotting procedure during transit.

SUMMARY OF THE INVENTION

It is one object of the invention to provide a macrame kit which permits the knot development with a minimum of cord entanglement.

It is another object of the invention to provide a macrame kit which includes a board and cord-holding elements which do not require the penetration of such elements into either the cord or the board so as to adversely affect either.

It is still another object of the invention to provide a macrame kit which includes a carrying case which, in cooperation with the macrame board and pole elements, enables one to continue the macrame procedure while in transit.

Other objects and advantages of the invention will become readily apparent from the following description of the invention.

According to the present invention there is provided a macrame board and kit comprising: a macrame board having top, bottom and side peripheral edges, a central area provided with an array of apertures, the bottom peripheral edge of the board having a scalloped section at least partially coextensive laterally with said apertured area, the upper peripheral edge of the board being formed with a cut-out section at least partially coextensive laterally with said apertured area, and the opposed side peripheral edges having a plurality of inwardly directed slots.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 8:
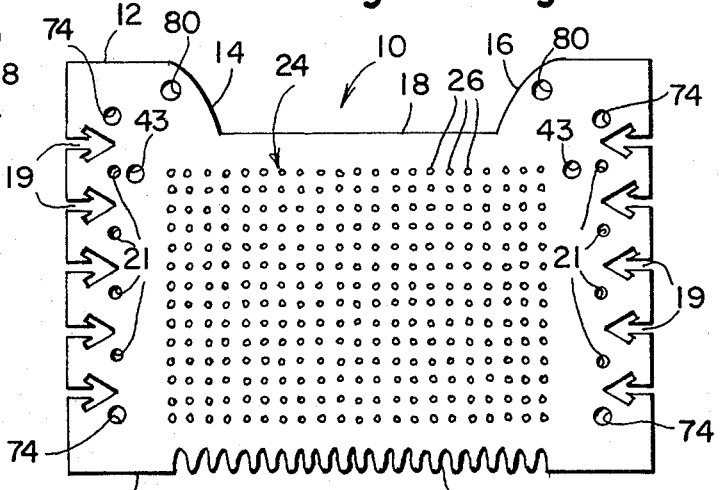
FIG. 8 is a top plan view of the macrame board.

Referring to the drawings, particularly to FIG. 8 thereof, there is shown a macrame board 10. The board may be given a rectangular or square configuration although it will be understood that the exact configuration of the board is not critical. The board should be provided, however, with a generally horizontally disposed upper peripheral edge 12 which is inwardly directed as at 14, 16 to provide a cut-out section 18. The lower peripheral edge 20 of the board is formed with a scalloped section 22 which is preferably substantially coextensive with a central apertured area 24 to be hereafter described. The scallops desirably take the form of a plurality of converging strips which terminate in rounded tips. The scalloped edge thus affords a convenient means of maintaining the depending cords in spaced parallel relation so as to minimize entanglement of such cords.

The central area of the board is provided with an array of apertures 26 which are desirably uniformly spaced and arranged in columns and rows. A convenient pattern of apertures is one which is rectangular and comprises 36 columns and 23 rows of apertures. However, the particular pattern of apertures is not critical and may be varied, the significant factor being that the apertures should be located in the central area of the board and extend laterally across the board. The cut-out section 18 and the scalloped edge of cord separators should desirably be generally coextensive with the lateral extent of the apertured central area.

The opposed side edges of the board are given a plurality of notches 19 which are in aligned relation. Each of such notches extends inwardly from the peripheral edge of the board and are desirably formed in the shape of arrows. Between each pair of adjacent notches there may conveniently be formed apertures 21 for the storage of cord-retaining elements 28 to be later described.

Figure 6:
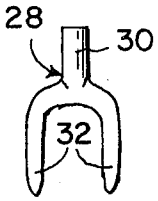
FIG. 6 is a perspective view of a cord-retaining element.

A plurality of cord-holding or cord-retaining elements 28 are provided for the purpose of locating the cords at a particular situ in the central area of the board. The elements 28 thus are formed with a peg or stem section 30 at one end which is dimensioned to be detachably secured within one of the apertures 26. The other end of the cord-retaining element is given a pair of spaced parallel legs 32 between which the cord is retained. FIG. 6 provides an illustration of the presently preferred form of cord-retaining element.

Figure 9A:
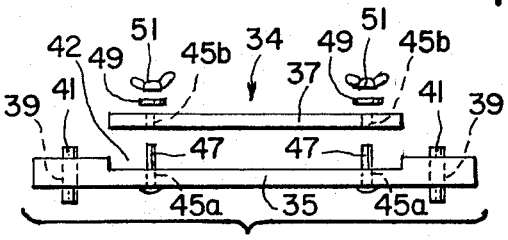
FIGS. 9*a* and 9*b* are perspective views of the starter bar.
Figure 9B:
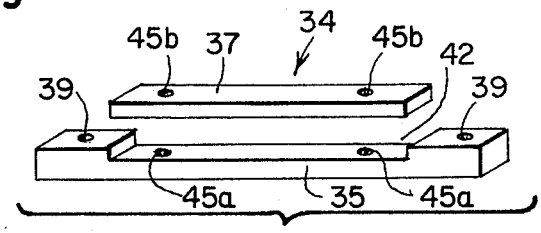

A starter bar 34 is illustrated in FIG. 9 and can be seen as being elongated and made up of a lower base section 35 and an upper section 37. The lower section is provided adjacent each end thereof with an aperture 39 dimensioned to receive respective bar legs 41 in the form of pins having a configuration complementary to that of apertures 39. Such bar legs are also dimensioned to fit within apertures 80 in the board 10 to support the starter bar across cut-out section 18. The lower section of the starter bar is also provided with a pair of apertures 45*a* alignable with a pair of similarly dimensioned apertures 45*b* in the upper section 37. When the upper and lower sections are brought into aligned relation for assembly apertures 45*a* and 45*b* are aligned and bolts 47 and washers 49 are employed to secure the sections together detachably. In use, the starter bar is mounted on board 10 by virtue of bar legs 41 in apertures 80. An accessory element (not shown) is inserted in recessed section 42 between the upper and lower sections 35, 37 by loosening wing nuts 51 and by raising the upper section 37. The wing nuts are then tightened to hold the accessory element firmly in place. Cords are then looped on the accessory element. When sufficient knotting has been achieved the wing nuts are again loosened and the looped, knotted accessory element is pulled between the upper and lower sections of the starter bar. The wing nuts are again tightened and the process of knotting is continued.

Figure 3:
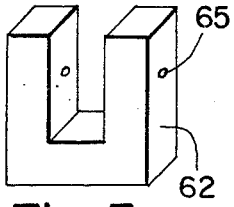
FIG. 3 is a perspective view of a support for one of the elevating poles.

The macrame kit is also unique in its adaptation for use when the macrame artist is en route from one location to another. Thus, a carrying case 46 is specially adapted to house the board or to serve as a mount for the board if it is to be used while the artist is in transit. The carrying case includes top and bottom sections 48, 50 hingedly connected as at 53. Each of such sections comprises end walls 52, 54 and opposed side walls 56, 58. As stated above, the interior of the carrying case is dimensioned to receive the macrame board for in transit storage or for storage generally when not in use. Within the case, preferably secured to bottom wall 60 of the bottom section, a first pair of elevating pole support elements 62*a*, 62*b* is positioned adjacent one of the end walls in spaced relation with respect to each other and inwardly of the adjacent side walls. A second pair of elevating pole support elements 64*a*, 64*b* are attached to bottom wall 60 in alignment with the first pair of such elements and adjacent the opposite end wall. Each of the pole support elements is substantially U-shaped and is secured to the bottom wall of the case at the bight portion thereof. A first pair of such pole support elements are provided with a pin hole 65 therethrough as shown in FIG. 3 in order to accommodate a pin element. In this manner one end of each of a pair of elevating poles 66, to be later described, can be mounted in the support elements having the pin hole arrangement so as to be freely pivotable at the other end for support of the macrame board in the manner illustrated in FIG. 1. Also, the poles can be pivoted downwardly so as to nest within the opposed pairs of support elements when not in use.

Figure 1:
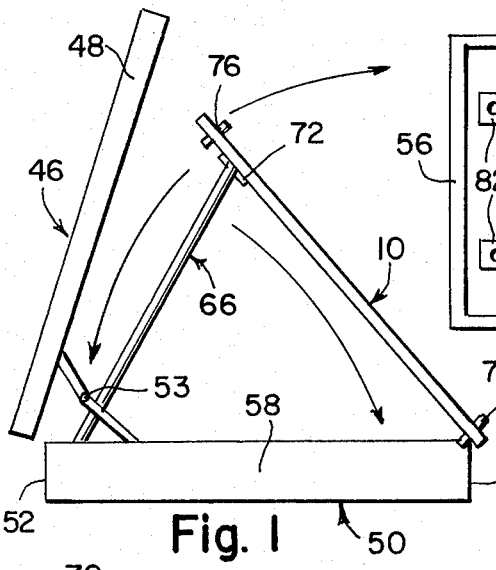
FIG. 1 is a side view of the macrame kit of the invention in working position in its carrying case.

A pair of elevating pole elements 66 is desirably included in the kit, each such element constituting a shaft 68 which is apertured at one end thereof as at 70 to accommodate a transverse pin 72 and is given an oblique end face 75 at the other end. The pin element 72 extends beyond the side walls of the pole and, as illustrated in FIG. 1, serves as a support for the upper portion of the macrame board when the board is to be used in conjunction with the carrying case as during transit.

Figure 7A:
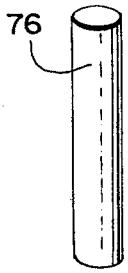
FIG. 7*a* and FIG. 7*b* are perspective views respectively of the back and front board legs.
Figure 7B:
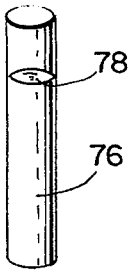

The board 10 is given an aperture 74 in the region of each corner thereof and a leg element 76 is positionable within each of such apertures. The leg element for the upper portion of the board is shown in FIG. 7*a* and comprises a cylindrical peg. The leg element for the lower portion of the board is depicted in FIG. 7*b* and is identical to that shown in FIG. 7*a* except for the provision of a transverse notch 78 therein. The transverse notch serves to mount the macrame board upon the end wall 54 of the carrying case when it is to be used as shown in FIG. 1.

The macrame board is provided with an additional aperture 80 adjacent each of the upper corners thereof. Such additional apertures are dimensioned to slideably receive a pair of legs 41 carried by starter bar 34 to secure the starter bar across cut-out section 18 as stated above.

A pair of elevating pole apertures 43 are formed in the macrame board adjacent the upper corner holes 26 directly inward of the upper peg storage apertures 21 as can best be seen from FIG. 8.

Figure 2:
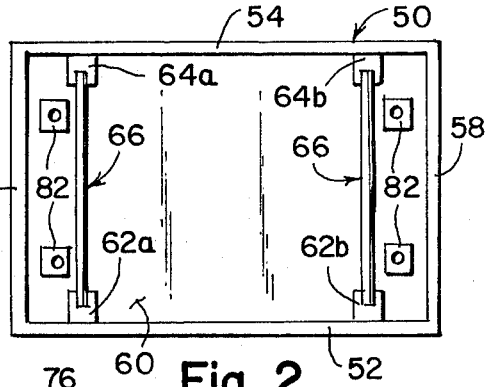
FIG. 2 is a top plan view of the inside of the carrying case with the macrame board removed therefrom.
Figure 4:
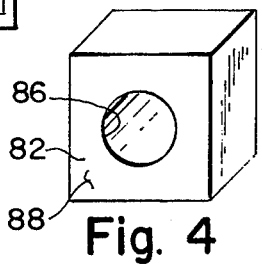
FIG. 4 is a perspective view of a receiving member for one of the legs of the knotting board.
Figure 5A:
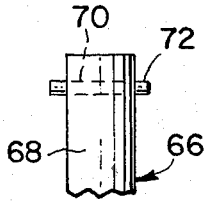
FIG. 5*a* is a fragmentary elevational view of the end of one of the elevating poles.
Figure 5B:
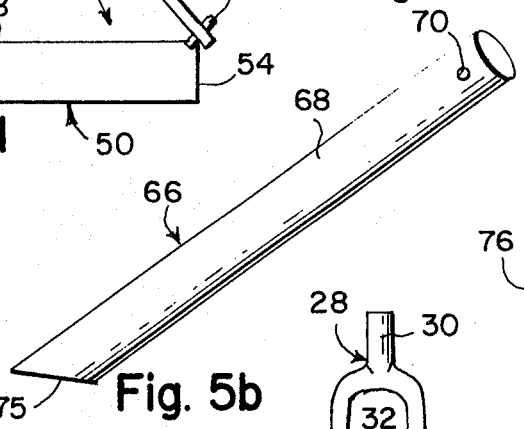
FIG. 5*b* is a side perspective view of an elevating pole.

Turning once again to the construction of the carrying case, and to FIGS. 2 and 4 of the drawings, it will be seen that a board leg receiving element 82 is secured to the bottom wall of the case adjacent each corner thereof. Each of such leg receiving elements essentially comprises a block having a bore 86 in the upper face 88 thereof dimensioned to receive one of the legs 76. The bores are of sufficient depth that when the board is to be stored within the carrying case the board legs will nest therewithin to maintain the board securely within the case. The exact location of the attachment of leg receiving elements 82 to the bottom wall of the carrying case will be dependent upon the board dimensions and the location of the board legs thereon so that proper alignment of the board within the case can be achieved in order to afford the secure storage referred to above.

Figure 10:
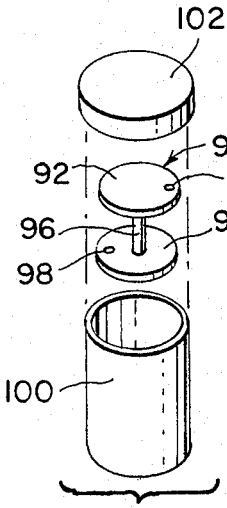
FIG. 10 is a perspective view of a cord winding bobbin.

The kit includes a plurality of cord winding bobbins 90, preferably constructed as shown in FIG. 10, so as to provide a supply of cord for use in the macrame procedure. Each of the bobbins is given a pair of end discs 92, 94 and a stem 96 connected between the discs. At least one hole 98 is formed in each of the end discs for commencing the winding of the cord. The bobbins are dimensioned lengthwise, preferably, so that they can be stored within the carrying case between the sidewall of the case and the pole element stored therein and at one end of the case between the pole elements. The bobbins are positioned in side-by-side parallel relation during such storage. Desirably, such bobbins are stored within a capsule 100 preferably made of a synthetic plastics material. A flexible cap 102 is provided for the capsule. Such storage of the bobbins when they are wound with cord serves to protect the cord against unnecessary exposure. To wind cord upon the bobbin one end of the cord is inserted into hole 98 and the cord is then wound about stem 96 from one disc to the other and alternately back and forth until the bobbin is fully wound.

The macrame board may be made of a material which need not permit penetration thereof by a pin or needle element as was required of boards available heretofore. Thus, the board may conveniently be made of one of the hard woods, a synthetic plastics such as nylon or plexiglass or of a light metal such as brushed aluminum. One of the primary factors in the selection of a suitable material would be the ultimate attractiveness of the board. However, another factor is durability. The prior boards, in requiring the characteristic of penetrability, precluded the use of many materials which can be employed in the construction of the board of the present invention.

From the foregoing it will be seen that a macrame kit has been provided which is extremely attractive and which possesses utility not possible with prior boards of this character. Further, in being adapted for use with the carrying case described above, the board can be safely secured for transportation from one location to another and can be used in transit so as to make available time which would otherwise be wasted.

We claim:

1. A macrame board for fabricating items by the knotting of cords, comprising:

a board having top, bottom and side peripheral edges, a central area provided with an array of apertures, the bottom peripheral edge of the board having a laterally extending scalloped section substantially coextensive with said apertured area, the top peripheral edge of the board being formed with a single cutout section substantially coextensive laterally with said apertured area, and each of the opposed side peripheral edges having a plurality of peripherally spaced inwardly directed slots, at least one of said slots being in the configuration of an inwardly pointing arrow; and starter means removably attached to said board adjacent said top peripheral edge for holding the finished portion of said item during the course of fabrication.

2. A macrame board according to claim 1, including a first set of apertures formed respectively adjacent the corners thereof and dimensioned to each receive a board leg element therein and an additional aperture formed adjacent each of the upper corners of the board for receiving respective elevating pole elements therein.

3. A macrame board and kit comprising:

a board having top, bottom and side peripheral edges, a central area provided with an array of apertures arranged in the form of a plurality of rows and columns uniformly spaced apart, the bottom peripheral edge of the board having a laterally extending scalloped section substantially coextensive with said apertured area, the upper peripheral edge of the board being formed with a cut-out section at least partially coextensive laterally with said apertured area, and each of the opposed side peripheral edges having a plurality of peripherally spaced inwardly directed slots;

a first set of apertures formed respectively adjacent the corners of said board and dimensioned to receive a board leg element therein and an additional aperture formed in said board adjacent each of the upper corners thereof;

a plurality of cord-retaining elements each including a stem at one end thereof dimensioned to be removably secured within sealed apertures of said array and the other end adapted to releasably retain a cord;

a starter bar member adapted to be detachably connected to the upper portion of said board transversely thereof within said cut-out section;

a first pair of elongated leg elements dimensioned to be securable within the apertures of said first leg located in the upper corners of the board to extend rearwardly thereof, a second pair of elongated leg elements dimensioned to be securable within the apertures of said first set located in the lower corners of the board to extend rearwardly thereof, each of said second pair of leg elements having a transverse notch formed therein;

a pair of elevating poles dimensioned at least at one end thereof to slidably fit within respective ones of said additional apertures, each of said elevating poles being provided at said one end with a transverse aperture and a pin element positioned therein and extending beyond the sides of the pole, the other end of each of said elevating poles having an oblique end face;

and a carrying case for said board, leg elements and elevating poles.

4. A macrame board and kit according to claim 3, wherein the other end of said cord-retaining element comprises a pair of parallel legs connected by a bight secton at the juncture with said stem.

5. A macrame board and kit according to claim 3, said carrying case comprising top and bottom sections having top and bottom walls respectively and peripheral end and side walls, said sections being pivotably connected by hinge means at one end thereof, said case being dimensioned interiorly to receive said board for storage, a first pair of substantially U-shaped elevating pole support elements secured to said bottom wall adjacent one of said end walls in spaced relation to and inwardly of said side walls, a second pair of similarly configured elevating pole support elements secured to said bottom wall adjacent the opposed end wall and in alignment with said first pair of support elements, the pair of support elements secured adjacent the hinged end of the case being adapted to pivotally receive said other ends of said elevating poles, and said bottom wall having secured thereto in the region of each corner thereof a board leg receiving element adapted to releasably receive one of said board legs.

6. A macrame board and kit according to claim 3, wherein said starter bar is elongated and is provided with a first elongated through slot extending between the front and rear faces thereof, a second slot being formed in the upper face thereof and extending downwardly to be in communication throughout with said first slot.

7. A macrame board and kit according to claim 6, including a wedge-shaped element dimensioned to be insertable through the slots of said starter bar.

8. A macrame board and kit according to claim 3, including a plurality of cord winding bobbins each adapted to hold a supply of cord thereon, each of said bobbins comprising a pair of end discs and a stem connected therebetween, each of said discs having at least one hole therein for the withdrawal of cord from the bobbin.

9. A device for fabricating decorative items by the knotting of cords, comprising:

a board having top, bottom and side peripheral edges and a central area provided with an array of apertures, the bottom peripheral edge haing a laterally extending scalloped section substantially coextensive with said apertured area;

starter means disposed laterally along said board substantially coextensive with said apertured area and removably attached to said board adjacent said top peripheral edge for holding the finished portion of said decorative item during the course of fabrication, said starter means comprising a slotted member;

cord-holding means in said side peripheral edges for preventing the tangling of said cords when said board is carried from place to place, said cord-holding means comprising an inwardly directed slot in each of said side peripheral edges; and means for retaining said decorative item in said slotted member.

10. The device according to claim 9 wherein each of said inwardly directed slots is given the configuration of an inwardly pointing arrow.

11. The device defined in claim 9 wherein said means for retaining said decorative item in said slotted member is a wedge.

* * * * *